US005646471A

United States Patent [19]

Schöller et al.

[11] Patent Number: 5,646,471

[45] Date of Patent: Jul. 8, 1997

[54] CAPPED HIGH-PRESSURE DISCHARGE LAMP

[75] Inventors: Klaus Schöller, Nideggen; Helmut Tiesler-Wittig, Köln, both of Germany

[73] Assignee: U.S. Philips Corporation, New York, N.Y.

[21] Appl. No.: 437,749

[22] Filed: May 9, 1995

[30] Foreign Application Priority Data

May 10, 1994 [EP] European Pat. Off. ..... 94201318

[51] Int. Cl.[6] ..... H01J 61/35

[52] U.S. Cl. ..... 313/25; 313/634; 313/112; 313/117

[58] Field of Search ..... 313/25, 117, 634, 313/635, 112

[56] References Cited

U.S. PATENT DOCUMENTS 4,307,315 12/1981 Meulemans et al. ..... 313/112
4,794,297 12/1988 Gaugel et al. ..... 313/117

FOREIGN PATENT DOCUMENTS 0237647 9/1987 European Pat. Off. .
0570068 11/1993 European Pat. Off. .
0579313 1/1994 European Pat. Off. .
0579326 1/1994 European Pat. Off. .
0581354 2/1994 European Pat. Off. .

*Primary Examiner*—Nimeshkumar Patel
*Attorney, Agent, or Firm*—Walter M. Egbert; Brian J. Wieghaus

[57] ABSTRACT

The capped high-pressure discharge lamp suitable for use in a vehicle headlight has a discharge vessel which is surrounded by an outer envelope. Current conductors extend from a respective electrode to a respective contact at a cap in which a first neck-shaped portion of the discharge vessel is secured. A return portion of one current conductor extends along an outside surface of the outer envelope. The outer envelope has a light-absorbing coating in a region near the first neck-shaped portion, at a side which is remote from the return portion. The outer envelope may have band-shaped coatings at either side, aside from the discharge path between the electrodes, at its side which faces the return portion. Stray light in the beam formed by the reflector and the lens of a head-light in which the lamp is used, is obviated. The bands provide for a rectilinear light/dark transition in said beam.

10 Claims, 1 Drawing Sheet

CAPPED HIGH-PRESSURE DISCHARGE LAMP

BACKGROUND OF THE INVENTION

The invention relates to a capped high-pressure discharge lamp comprising:

a light-transmitting lamp vessel which is closed in a vacuumtight manner and which encloses a discharge space with an ionizable filling, wherein electrodes are arranged in mutual opposition so as to define a discharge path between them, which lamp vessel has an axis and a first and a second neck-shaped portion with a seal;

a glass tubular outer envelope around the discharge space, surrounding the discharge vessel with clearance, which envelope is connected to the lamp vessel and is filled with gas;

a lamp cap which is provided with contacts and in which the first neck-shaped portion is secured;

a first and a second current conductor, each connected to a respective electrode and extending through the respective first and second neck-shaped potion respectively to a respective contact at the lamp cap, the second current conductor having a return portion which extends along an outside of the outer envelope.

Such a capped high-pressure discharge lamp is known from European Patent Application EP-0 570 068-A1.

The outer envelope of the lamp is useful for reducing the temperature differences of the lamp vessel during operation. Reduced temperature differences can raise the luminous flux of the lamp while the power consumption remains the same. A rise in the luminous flux can even be realised at a maximum lamp vessel temperature corresponding to the maximum temperature in the absence of the envelope. It is also possible to realise a reduction in the maximum temperature while maintaining the same luminous flux as that given by a non-enveloped lamp. The luminous flux and the maximum temperature are dependent on the value of the clearance between the outer envelope and the lamp vessel.

The known lamp is particularly suitable for use as a vehicle headlight lamp. The light source of the lamp, the discharge are, has a high brightness while the consumed power of approximately 35 W is converted into light with a comparatively high luminous efficacy. As a result, the lamp can be used in a headlight with a comparatively small reflecting surface, so that the headlight can have a comparatively small height. Nevertheless, a more brightly illuminated road surface is then obtained for the vehicle with the lamp inside than is the case with conventional incandescent lamps as the light source. It was found, however, that a headlight with the capped high-pressure discharge lamp may radiate stray light, which may give rise to glare, also owing to the high brightness of the light source and the high luminous flux, and also dependent on the type of headlight.

Capped high-pressure discharge lamps of the kind described are also known from EP-0 581 354-A1, EP-0 579 326-A1, and EP-0 579 313-A1.

EP-0 237 647-A1 discloses a high-pressure discharge lamp which can be used as a vehicle headlight lamp and whose lamp vessel is surrounded by an evacuated tubular outer bulb of hard glass. This bulb is provided with a radiation-absorbing coating over its entire length and over half its circumference minus approximately 15°, and is provided with an IR-reflecting, light-transmitting coating over its remaining surface area.

The radiation-absorbing coating over a circumferential angle of 180°–15° has for its object to create an asymmetrical light beam in a headlight with a paraboloidal reflector for right-hand and left-hand traffic.

It was found that such a coating in a lamp of the kind mentioned in the opening paragraph, even with the use of quartz glass for the outer envelope and even in the absence of an IR-reflecting coating, causes such high temperatures that lamp life is strongly reduced, the tureen output of the lamp drops quickly, and deformations occur.

SUMMARY OF THE INVENTION

It is an object of the invention to provide a capped high-pressure discharge lamp of the kind described in the opening paragraph with which the occurrence of stray light is counteracted.

According to the invention, this object is achieved in that the outer envelope has a light-absorbing coating in a zone situated near the first neck-shaped potion at the side thereof facing away from the return portion of the second current conductor, which zone extends at least from a location enclosing an angle $\alpha$ of 50° with the perpendicular to the outer envelope at the area of the centre between the electrodes, at least up to a location which encloses an angle $\beta$ of approximately 65° with said perpendicular, the vertex points of $\alpha$ and $\beta$ lying on the axis of the lamp vessel.

It was in fact found that stray light is caused by radiation thrown in the direction of the first neck-shaped portion and deflected by the lamp vessel material, and subsequently hitting the reflector in a zone which extends around the lamp cap at the upper side thereof. The reflector always holds the lamp in such a manner that the second current conductor runs below the lamp vessel towards the lamp cap.

Light which hits the reflector in the absence of the coating will be blended with the useful light reflected by the reflector and thrown to the exterior in a beam through the headlight lens, substantially straight ahead, far ahead of the headlight. This is exactly why this stray light is so unpleasant.

The angle $\alpha$ may be chosen to be a few degrees smaller and may be, for example, 40°, without an appreciable influence on the luminous flux in a beam formed by a headlight. The angle $\beta$ may be chosen to be greater so as to have a wider manufacturing tolerance, but widening this angle has little useful effect in other respects.

In a favourable embodiment of the high-pressure discharge lamp according to the invention, the outer envelope has a band-shaped, light-absorbing coating on either side laterally of the discharge path at the side thereof facing the return portion of the second current conductor, which band-shaped coatings have edges facing away from one another and enclosing an angle $\gamma$ of substantially 165°, and edges facing towards one another and enclosing an angle $\delta$ of 85° to 145° with one another, the vertex points of $\gamma$ and $\delta$ lying on the lamp vessel axis.

The angle $\gamma$ is the angle of the asymmetrical beam for left-hand or right-hand traffic. The freedom of choice for angle $\delta$ provides a tolerance for manufacture and gives a minimum desired width and a maximum allowed width for the bands, the latter not to be exceeded for thermal reasons.

This embodiment has the advantage that a headlight in which the lamp is used can form a rectilinear light/dark boundary in the generated light beam by means of its reflector and lens. A comparatively great luminous flux can be thrown to far in front of the vehicle having the headlights thereby, while it is avoided that light is also aimed above the horizon. Such light may dazzle oncoming traffic. Without the band-shaped coatings, the headlight with the lamp would have to be aimed lower in order to avoid this risk, and the road surface would be illuminated over a shorter distance. A non-rectilinear light/dark boundary without the band-shaped coatings results from the fact that the discharge are is slightly curved upwards owing to convection flows in the lamp vessel. Reflector and lens as a result do not make rectangular images of the light source at the light/dark boundary, but crescent-shaped images, and thus a non-rectilinear light/dark boundary.

An advantage of this embodiment is also that the band-shaped coatings have no or substantially no influence on lamp life and lumen maintenance during lamp life. The light radiated between the band-shaped coatings can be used for illuminating the road surface close in front of the vehicle with the lamp.

The measures in the capped high-pressure discharge lamp according to the invention may be advantageously applied in a capped high-pressure discharge lamp wherein the discharge vessel surrounding the discharge space has a circumferential clearance inside the outer envelope of at most 2 mm. The lamp then has a comparatively high luminous efficacy at comparatively low temperatures.

The coatings of the outer envelope may be realised with conventional materials used for incandescent lamps in headlights, for example, a suspension of carbonyl iron and silicon. The coatings may be provided with a brush, with a printing technique, or by spraying, for example with an ink jet.

BRIEF DESCRIPTION OF THE DRAWINGS

An embodiment of the capped high-pressure discharge lamp according to the invention is shown in the drawing, in which.

DESCRIPTION OF THE PREFERRED EMBODIMENTS

Figure 1:
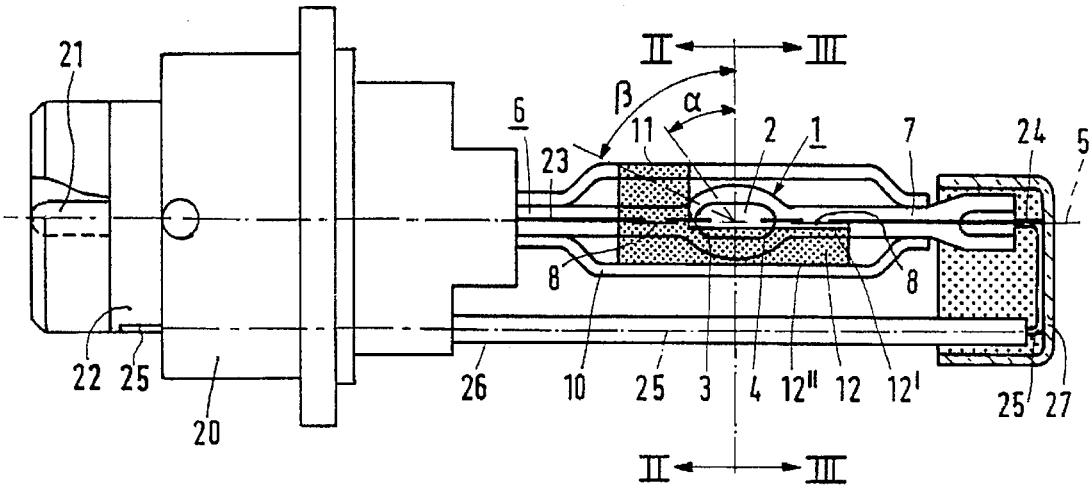
FIG. 1 shows a lamp in side elevation.

In FIG. 1, the capped high-pressure discharge lamp has a light-transmitting lamp vessel 1, made of quartz glass in the Figure, which is closed in a vacuumtight manner and encloses a discharge space 2 with an ionizable filling in which electrodes 3, 4 are arranged in mutual opposition so as to define a discharge path between them. The filling comprises, for example, mercury, a mixture of metal halides such as sodium and scandium iodide, and a rare gas such as, for example, xenon, for example with a filling pressure of several bar. The lamp vessel has an axis 5 and a first 6 and a second neck-shaped portion 7 with seal 8.

A tubular, glass, for example quartz-glass outer envelope 10 is present around the discharge space 2, surrounding the discharge vessel 1 with clearance, is connected to the lamp vessel 1, and is filled with gas, for example with air.

The lamp has a lamp cap 20 provided with contacts 21, 22, in which cap the first neck-shaped portion 6 is fixed. A first 23 and a second current conductor 24, each connected to a respective electrode 3, 4, extend through the first 6 and the second neck-shaped portion 7, respectively, to a respective contact 21, 22 at the lamp cap 20. The second current conductor 24 has a return portion 25 which extends along an outer side of the outer envelope 10.

Figure 2:
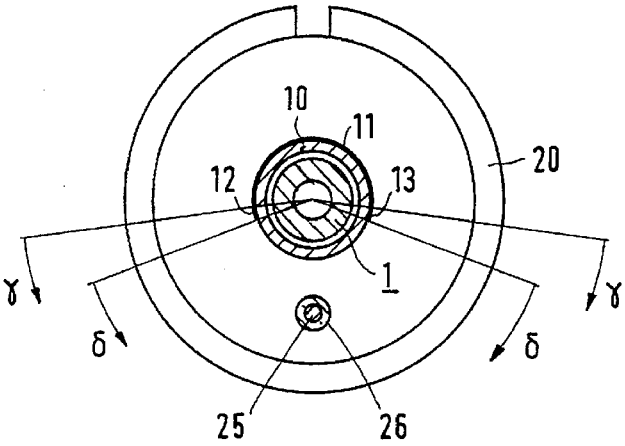
FIG. 2 is a cross-section taken on the line II—II in FIG. 1, with the contours of the lamp cap.
Figure 3:
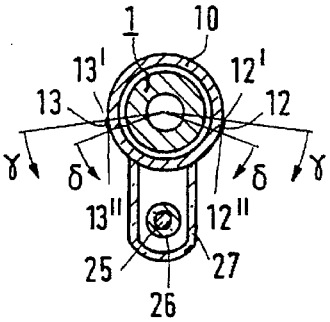
FIG. 3 is a cross-section taken on the line III—III in FIG. 1.

The outer envelope 10 has a light-absorbing coating 11, see also FIGS. 2 and 3, in a zone situated near the first neck-shaped portion 6 at the side thereof facing away from the return portion 25 of the second current conductor 24. The zone extends at least from a location which encloses an angle $\alpha$ of 50°, in the FIG. 40°, with the perpendicular to the outer envelope 10 at the centre between the electrodes 3, 4, at least up to a location which encloses an angle $\beta$ of approximately 65° with said perpendicular. The vertex points of $\alpha$ and $\beta$ lie on the axis 5 of the lamp vessel 1.

A ceramic pipe 26 is present around the return portion 25 in the Figure, which pipe is accommodated in the lamp cap 20 at one end and is fixed with cement in a ceramic cap 27 at another end. The lamp is electrically safe to touch when rendered live via a connector on the lamp cap.

The outer envelope 10 has a band-shaped light-absorbing coating 12, 13 on either side laterally of the discharge path at the side thereof facing the return portion 25 of the second current conductor 24. These band-shaped coatings 12, 13 have edges 12', 13' facing away from one another and enclosing an angle $\gamma$ of substantially 165°, and mutually facing edges 12", 13" which enclose an angle $\delta$ of 85° to 145°. The vertex points of $\gamma$ and $\delta$ lie on the axis 5 of the lamp vessel 1.

The discharge vessel 1 has a circumferential clearance of at most 2 mm inside the outer envelope surrounding the discharge space 2, in the FIG. 0.35 mm.

Stray light is effectively counteracted in the lamp.

We claim:

1. A capped high-pressure discharge lamp comprising:

a light-transmitting lamp vessel which is closed in a vacuumtight manner and which encloses a discharge space with an ionizable filling, wherein electrodes are arranged in mutual opposition so as to define a discharge path between them, which lamp vessel has an axis and a first and a second neck-shaped portion with a seal;

a glass tubular outer envelope around the discharge space, surrounding the discharge vessel with clearance, which envelope is connected to the lamp vessel and is filled with gas;

a lamp cap which is provided with contacts and in which the first neck-shaped portion is secured;

a first and a second current conductor, each connected to a respective electrode and extending through the respective first and second neck-shaped portion respectively to a respective contact at the lamp cap, the second current conductor having a return portion which extends along an outside of the outer envelope, characterized in that the outer envelope has a light-absorbing coating in a zone situated near the first neck-shaped portion at the side thereof facing away from the return portion of the second current conductor, which zone extends least from a location enclosing an angle $\alpha$ of about 50° with the perpendicular to the outer envelope at the area of the centre between the electrodes, at least up to a location which encloses an angle $\beta$ of approximately 65° with said perpendicular, the vertex points of $\alpha$ and $\beta$ lying on the axis of the lamp vessel.

2. A capped high-pressure discharge lamp as claimed in claim 1, characterized in that the outer envelope has a band-shaped, light-absorbing coating on either side laterally of the discharge path at the side thereof facing the return portion of the second current conductor, which band-shaped coatings have edges facing away from one another and enclosing an angle $\gamma$ of substantially 165°, and edges facing towards one another and enclosing an angle $\delta$ of 85° to 145° with one another, the vertex points of γ and δ lying on the axis of the lamp vessel.

3. A capped high-pressure discharge lamp as claimed in claim 2, characterized in that the discharge vessel surrounding the discharge space has a circumferential clearance inside the outer envelope of at most 2 mm.

4. A capped high-pressure discharge lamp as claimed in claim 1, characterized in that the discharge vessel surrounding the discharge space has a circumferential clearance inside the outer envelope of at most 2 mm.

5. A capped high-pressure discharge lamp comprising:

a light-transmitting lamp vessel which is closed in a vacuumtight manner and which encloses a discharge space with an ionizable filling, wherein electrodes are arranged in mutual opposition so as to define a discharge path between them, which lamp vessel has an axis and a first and a second neck-shaped portion with a seal;

a glass tubular outer envelope around the discharge space, surrounding the discharge vessel with clearance, which envelope is connected to the lamp vessel and is filled with gas;

a lamp cap which is provided with contacts and in which the first neck-shaped portion is secured;

a first and a second current conductor, each connected to a respective electrode and extending through the respective first and second neck-shaped portion respectively to a respective contact at the lamp cap, the second current conductor having a return portion which extends along an outside of the outer envelope, characterized in that the outer envelope has a light-absorbing coating in a zone situated near the first neck-shaped portion at the side thereof facing away from the return portion of the second current conductor, which zone extends from a location enclosing an angle α of about 50° with the perpendicular to the outer envelope at the area of the center between the electrodes, at least up to a location which encloses an angle β of approximately 65° with said perpendicular, the vertex points of α and β lying on the axis of the lamp vessel.

6. A capped high-pressure discharge lamp as claimed in claim 5, characterized in that the outer envelope has a band-shaped, light-absorbing coating on either side laterally of the discharge path at the side thereof facing the return portion of the second current conductor, which band-shaped coatings have edges facing away from one another and enclosing an angle γ of substantially 165°, and edges facing towards one another and enclosing an angle δ of 85° to 145° with one another, the vertex points of γ and δ lying on the axis of the lamp vessel.

7. A capped high-pressure discharge lamp as claimed in claim 6, characterized in that the discharge vessel surrounding the discharge space has a circumferential clearance inside the outer envelope of at most 2 mm.

8. A capped high-pressure discharge lamp as claimed in claim 6, characterized in that the discharge vessel surrounding the discharge space has a circumferential clearance inside the outer envelope of at most 2 mm.

9. A capped high-pressure discharge lamp as claimed in claim 5, characterized in that the outer envelope has a band-shaped, light-absorbing coating on either side laterally of the discharge path at the side thereof facing the return portion of the second current conductor, which band-shaped coatings have edges facing away from one another and enclosing an angle γ of substantially 165°, and edges facing towards one another and enclosing an angle δ of 85° to 145° with one another, the vertex points of γ and δ lying on the axis of the lamp vessel.

10. A capped high-pressure discharge lamp comprising:

a light-transmitting lamp vessel which is closed in a vacuumtight manner and which encloses a discharge space with an ionizable filling, wherein electrodes are arranged in mutual opposition so as to define a discharge path between them, which lamp vessel has an axis and a first and a second neck-shaped portion with a seal;

a glass tubular outer envelope around the discharge space, surrounding the discharge vessel with clearance, which envelope is connected to the lamp vessel and is filled with gas;

a lamp cap which is provided with contacts and in which the first neck-shaped portion is secured;

a first and a second current conductor, each connected to a respective electrode and extending through the respective first and second neck-shaped portion respectively to a respective contact at the lamp cap, the second current conductor having a return portion which extends along an outside of the outer envelope, characterized in that the outer envelope has a light-absorbing coating in a zone situated near the first neck-shaped portion at the side thereof facing away from the return portion of the second current conductor, which zone extends from a location enclosing an angle α of about 50° with the perpendicular to the outer envelope at the area of the center between the electrodes, the vertex point of α lying on the axis of the lamp vessel.

* * * * *